US006935084B1

(12) United States Patent
Larsen

(10) Patent No.: US 6,935,084 B1
(45) Date of Patent: Aug. 30, 2005

(54) TAPER-REAM WOOD REPAIR APPARATUS AND METHOD

(76) Inventor: Richard D. Larsen, 900 E. Piper Dr., New Brighton, MN (US) 55112

( * ) Notice: Subject to any disclaimer, the term of this patent is extended or adjusted under 35 U.S.C. 154(b) by 0 days.

(21) Appl. No.: 10/683,512

(22) Filed: Oct. 9, 2003

Related U.S. Application Data

(60) Provisional application No. 60/417,443, filed on Oct. 9, 2002.

(51) Int. Cl.[7] ..... E02D 37/00
(52) U.S. Cl. ..... 52/514; 52/741.1; 52/742.1; 52/749.1; 52/749.13
(58) Field of Search ..... 52/514, 514.5, 52/742.1, 749.1, 749.13, 13

(56) References Cited

U.S. PATENT DOCUMENTS

| | | | | |
|---|---|---|---|---|
| 276,499 | A | 4/1883 | Story | |
| 1,976,722 | A | 10/1934 | Goss et al. | |
| 4,295,763 | A | 10/1981 | Cunniff | |
| 4,382,720 | A * | 5/1983 | Vonach | 405/269 |
| 4,715,151 | A * | 12/1987 | Garblik | 52/2.18 |
| 4,807,415 | A * | 2/1989 | Oak | 52/514 |
| 4,811,531 | A * | 3/1989 | Vallerand | 52/127.5 |
| 4,894,971 | A | 1/1990 | Cortese | |
| 4,922,978 | A | 5/1990 | Koba | |
| 5,014,483 | A | 5/1991 | Southern | |
| 5,052,333 | A | 10/1991 | Woudsma | |
| 5,179,813 | A * | 1/1993 | Martinsen et al. | 52/742.13 |
| 5,244,123 | A * | 9/1993 | Benedict | 222/260 |
| 5,259,706 | A * | 11/1993 | Gaut | 408/1 R |
| 5,440,859 | A * | 8/1995 | Cortese | 52/742.1 |
| 5,947,971 | A * | 9/1999 | Kuslich et al. | 606/80 |
| 6,182,704 | B1 * | 2/2001 | Bevacco | 138/89 |
| 6,254,951 | B1 | 7/2001 | Marmalich | |
| 6,347,496 | B1 * | 2/2002 | Pinkins | 52/514 |
| 6,729,810 | B2 * | 5/2004 | Hyatt et al. | 408/1 R |
| 6,755,002 | B2 * | 6/2004 | Pendrous et al. | 52/514 |

OTHER PUBLICATIONS

Woodworking Tip: Plug Cutters—Use Straight or Tapered?, Aug. 2002, 1 page, Home Publishing Co., USA.
Fixing Broken Wood Screws & Stripped Heads,, Revised Jan. 19, 2002, 2 pages, WoodZone.com.
Shopsmith Hot Stuff-One-Part Instant Glues, 2003, 4 pages, Shopsmith,Inc.

* cited by examiner

*Primary Examiner*—Jeanette Chapman
(74) *Attorney, Agent, or Firm*—Albert W. Watkins

(57) ABSTRACT

A tapered plug having a compressible and conically tapered outer surface is permeated with a dry, water-activated adhesive. A pilot hole most preferably passes through the center of the tapered plug, ensuring proper alignment for a replacement fastener such as a wood screw or the like to be inserted therein. A handle is additionally provided for ease of installation. A ream useful in association with the plug and a method of installation of the plug are additionally disclosed.

18 Claims, 1 Drawing Sheet

TAPER-REAM WOOD REPAIR APPARATUS AND METHOD

CROSS REFERENCE TO RELATED APPLICATIONS

This application claims priority to U.S. provisional patent application Ser. No. 60/417,443 filed Oct. 9, 2002 and co-pending herewith, the contents which are incorporated herein by reference in entirety.

BACKGROUND OF THE INVENTION

1. Field of the Invention

This invention pertains generally to the field of woodworking, and more specifically to processes of restoring a stripped screw hole in a piece of finished dressed lumber.

2. Description of the Related Art

Many household products and many building structures are manufactured from wood and wood products, including such items as cabinets, doors, windows, furniture, and other items too numerous to list. Wood has many desirable characteristics which enables application in such diverse products. Unfortunately, joints and connections have traditionally failed long before the wood requires replacement.

These joints and connections frequently involve the use of a screw or other similar fastener, since such fastener is removable. The use of a removable fastener confers several benefits, including the ability to remove or replace the attached article. For example, doors such as may be used for human passage or providing closure for enclosed spaces may periodically become worn, damaged or otherwise require repair and replacement. Further, over time, such portals may also require minor re-adjustment.

Unfortunately, the same factors that may result in the wear or damage to the door may also inadvertently result in the damage of the screw hole within which the screw is anchored. Such damage has been relatively difficult to fix in the prior art, and persons have resorted to inserting tooth picks, steel wool or other materials into the hole together with the fastener to provide a pressure or frictional force fit to restore the hole. As is well known, none of these techniques provide the desired long-term strength that was present in the original hole, nor will these types of repairs be close in initial peak strength.

Some more effective, though more complex, repair techniques have long been used, including the drilling of a cylindrical hole followed by the insertion of a dowel or similar wooden pin therein. Several exemplary U.S. patents illustrate this technique, including U.S. Pat. No. 276,499 by Story and U.S. Pat. No. 5,052,333 by Woudsma, each which are incorporated herein by reference for their teachings. The dowel and hole must both be carefully prepared for this repair technique to be effective. Unfortunately, in the case of a stripped hole in wood, the hole will all too frequently be out-of-round, and may also be off-center from the original hole location. In other words, as the screw strips the hole, the hole will frequently be enlarged unevenly, such as with a bias in one direction or another. Consequently, the use of a standard drill bit to drill a standard cylindrical hole of slightly larger diameter is difficult, since the alignment of the larger drill bit may be difficult or impossible, subject to the geometry of the stripped hole. Even with a suitable geometry to accommodate drilling a cylindrical hole, the depth of the hole is both critical and also very difficult to judge. If the drilled hole is too shallow, the cylindrical repair plug will protrude from the hole, requiring cutting or sanding which can be both difficult and tedious, particularly where the surrounding wood would preferably not be altered or damaged in any way. If the hole is too deep, the plug may pass into the hole well below the surface of the surrounding wood, and in the process weaken the holding power of the newly inserted screw, owing to the reduced amount of wood for the screw to anchor into.

The cylindrical plug suffers from a second drawback. The holding power of the plug is frequently somewhat marginal, since the plug and/or the hole may not be of identical geometry. This may occur when one or the other are not quite cylindrical, or where the plug and hole diameters do not match well. In either case, the surface area for bonding is reduced, and the shear strength between the plug and surrounding material becomes much more dependent upon the shear strength of the adhesive. This is not desirable, but is a frequent result of the typical not-quite-cylindrical hole and plug preparation.

In order to reduce the effect of mismatched holes, some have proposed the use of a conical plug, such as U.S. Pat. No. 4,295,763 by Cunniff, the teachings which are incorporated herein by reference. The use of a slightly conical plug permits the plug to have a small region with diameter slightly larger than a hole, thereby inducing elastic deformation between plug and hole, and likewise compensating for any mismatch in diameter between plug and hole. Unfortunately, such technique does not provide a large surface area for the bonding, since the only region of contact is usually adjacent the outer surface of the repaired wood where the plug has the largest diameter. Farther in, the conical plug reduces in diameter below the diameter of the cylindrical hole and thereby forms a gap between plug and hole, making this conical plug and cylindrical hole poorly adhered relative to hole depth.

Others have proposed the use of a tapered bore and tapered repair plug. An exemplary patent, the teachings of which are incorporated herein by reference, is U.S. Pat. No. 4,894,971 to Cortese. Unfortunately, in the Cortese patent holes of a variety of shapes are introduced, several which would appear impossible to form or produce. The relevant tapered plug is tapered from large at both surfaces of the wood to a minimum at the center, which requires access at both surfaces of the wood, a luxury which is only extremely infrequently available. Furthermore, in the Cortese concept, the holes and plugs must still be fitted very precisely, or the opposed plug portions will mate together but not to the surrounding wood, or alternatively will mate to the surrounding wood and not to each other, which would in either case result in an inferior repair.

Since the advent of suitable liquid adhesives, semi-liquid resins, pastes and the like, a technique has been used which involves the introduction of resin into the damaged hole, followed by a suitable cure period, and then a drilling of appropriate pilot hole. This technique is also widely used, but requires substantial time for the hardening of the filler material. Further, the filler material does not have the intrinsic strength or appearance present in the natural material. Finally, the expansion coefficients due to moisture and temperature, and also the aging and discoloration over time are each frequently very different from wood, resulting in a tendency for this type of repair, even when perfectly executed, to degrade much more rapidly than a wood plug over time.

Each of the foregoing techniques suffer from yet another drawback. Once the stripped hole is appropriately filled, introduction of a screw or similar fastener is extremely difficult or impossible without the drilling of a pilot hole.

Unfortunately, there is no indication or guide left for the proper alignment of the new pilot hole. Consequently, it is entirely possible, and all to commonplace, for the pilot hole to be inadvertently placed or drilled at an improper angle or an off-center position relative to the original fastener location.

SUMMARY OF THE INVENTION

In a first manifestation, the invention is a repair plug for damaged screw holes in objects. The plug body has an outer generally conical surface with a porous and compressible exterior. An adhesive compound permeates at least the porous and compressible exterior.

In a second manifestation, the invention is a self-centering plug for restoring a damaged fastener hole in an object while preserving hole alignment and centering, pull-out strength and providing high initial strength. The plug body has a plug core which is generally conical and has a cone tip and cone base and which further defines a longitudinal axis between tip and a center of the cone base. A detachable handle is provided adjacent the cone base. An adhesive at least partially encompasses the plug core. A pilot hole extends co-axially with the longitudinal axis from the center of the cone base towards cone tip.

In a third manifestation, the invention is a method for repair of a damaged screw hole in an object using a reaming device and a generally conical plug. According to the method, the damaged screw hole is reamed with the reaming device to accept the conical plug. The reamed damaged screw hole is then tested for proper size, and the size adjusted through further reaming if necessary. An adhesive carried upon the conical plug is activated, and the conical plug is subsequently forced into the reamed damaged screw hole. A fastener is installed into the conical plug, and the adhesive is set to form an adhesive bond between conical plug and reamed hole. Additional steps that may be performed in association with this inventive method include applying an adhesive to the conical plug; de-activating the adhesive; forming an axially extensive and radially centered hole in the conical plug; and removing any metal device or obstruction from the damaged screw hole.

In a fourth manifestation, the invention is a ream for stripped fastener holes. A rotary power coupling shaft defines an axis of operative rotation. At least one cutting blade extends from a tip end of the ream to a relatively larger radius body distal thereto. The cutting blade has a circumferential thickness which tapers from a minimum adjacent the tip end to a maximum adjacent the relatively larger radius body. At least one flute runs adjacent the at least one cutting blade which is suitable for passage of material cut from stripped fastener holes.

OBJECTS OF THE INVENTION

A first object of the invention is to provide an improved fastening and repair technique. A second object of the invention is to enable persons without special skills or complex tools to perform the advantageous repair. Another object of the present invention is to enable the repair to gain or acquire substantial strength immediately, thereby eliminating any delay in the use or further working of the repaired location. A further object of the invention is to eliminate the need for handling of messy adhesives, and thereby reduce the commonplace drips and spills of the prior art. Yet another object of the present invention is to improve the visual and mechanical characteristics of the repair, both immediately and over time. An even further object of the invention is to intrinsically ensure proper alignment of a pilot hole within the repaired site, thereby simplifying the replacement of a fastener. Another object of the invention is the provision of intrinsic means to strengthen the plug.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
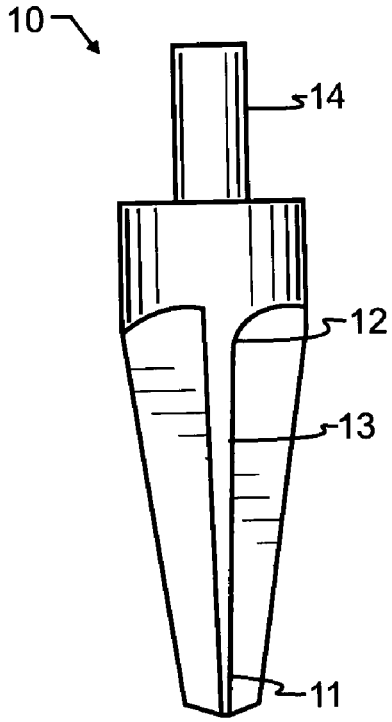
FIG. 1 illustrates a preferred embodiment tapered hole ream designed in accord with the teachings of the present invention from a side plan view.

Manifested in the preferred embodiment, the present invention provides a tapered reaming tool 10, illustrated in FIG. 1, that will preferably be used for opening up, enlarging, or shaping an existing opening in a substrate. Reaming tool 10 may take on other forms or geometries as desired for a particular application, and for shaping an opening in a particular substrate material. In the preferred embodiment, ream 10 may be used to form an expanded hole which is co-axial with the original fastener, to thereby maintain axial alignment of the replacement fastener. The slight angular expansion that occurs from tip 11 to flute end 12 provides a most preferred generally conical opening geometry, the full benefit of which will be explained more fully herein below. In addition, the slightly expanding width of cutting edge 13 from tip 11 to flute end 12 has been determined to reduce and in most cases completely eliminate undesirable bouncing that otherwise occurs within holes during the operation of reaming tool 10. This elimination of bounce is particularly important when reaming tool 10 is turned by a drill or other powered rotary tool.

In the preferred embodiment, ream 10 has a total of four cutting edges 13 which are angularly displaced by roughly ninety degrees from each adjacent cutting edge about the axis of rotation. Nevertheless, ream 10 could have any number of cutting edges 13. In the event only a single cutting edge is provided, a bearing surface opposed to cutting edge 13 would likely be necessitated to keep ream 10 in balance during rotation. Preferably, the cutting edges are so arranged as to intrinsically provide the necessary balance.

Figure 2:
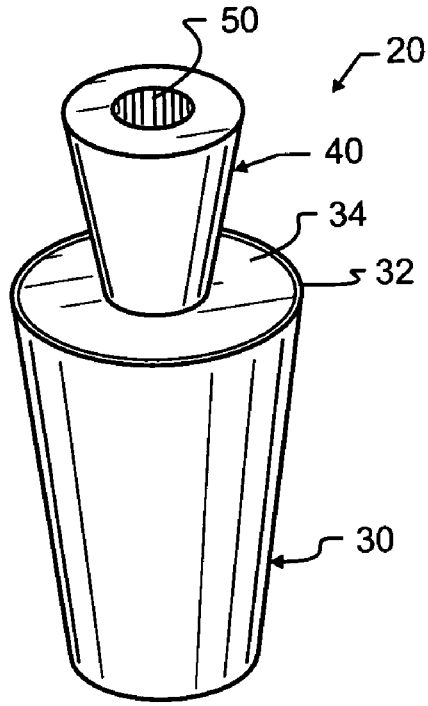
FIG. 2 illustrates a preferred embodiment plug designed in accord with the teachings of the present invention from a projected plan view prior to installation within a hole.
Figure 3:
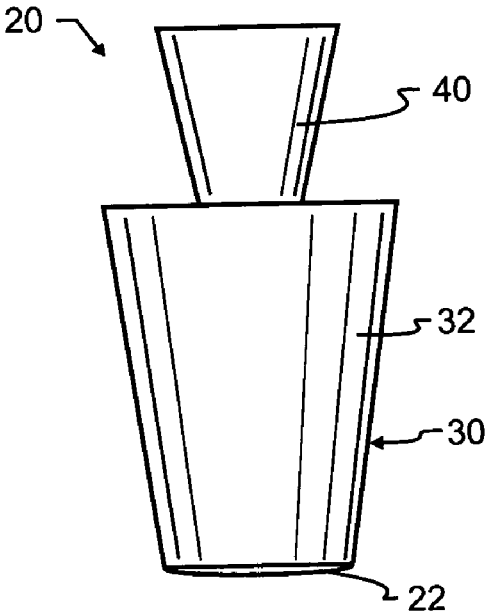
FIG. 3 illustrates the preferred embodiment plug of FIG. 1 from a side plan view.

At least one plug, such as plug 20 illustrated in FIG. 2, will be required to complete a hole repair. As may be apparent from the illustration, plug 20 will most preferably have a generally conical taper which is either identical to that of reaming tool 10 or sufficiently similar thereto to readily form an interference fit with a hole formed to correspond to reaming tool 10. In the preferred embodiment, the angle of taper of plug body 30 will preferably be between approximately four and ten degrees, though those skilled in the art will recognize that other angles may be used as well. Angles less than four degrees tend to form too close a fit, making the insertion more difficult. In addition, once the plug is inserted within a hole, the plug will too easily be pressed not only into proper alignment, but also may be pressed into or completely through a hole. Said another way, too small an angle of taper within a hole and within plug body 30 will permit the plug to pass too deeply into the hole before sufficient interference force is generated. Finally, too small an angle makes the application of the correct amount of compression upon the fibrous plug material, described herein below, extremely difficult to control. Conversely, angles greater than ten degrees begin to be relatively blunt, losing the frictional fit and necessary compression which is preferred in the present invention between plug 20 and a hole to provide desired initial strengths and suitable compression.

In the preferred embodiment, the substrate is a wooden substrate or one fabricated from manufactured wood product, though many other diverse materials may have applicability, as will become more apparent herein below. For this wooden or wood product substrate, plug 20 will preferably be produced from wood as well. In one embodiment, the wood may be an identical wood species and have matched grain, which will better ensure long term matching of expansion and contraction characteristics. However, this level of matching is not essential to the working of the invention, and a standard wood may be selected for characteristics that are most suited for application with a larger variety of wood and wood products. The species of wood selected is important to the most preferred operation, as will be further described herein below, but a medium hardness species such as birch is preferred over typically harder woods such as oak.

In the preferred embodiment, wood plug 20 or at least plug body 30 is most preferably provided with a rough finish. This may be achieved by abrasive contact, using a very rough or coarse abrasive, or may alternatively be produced as a part of the shaping of the plug by lathing or similar operation. Regardless of the method used, most preferably plug body 30 will be left with an open, most preferably fibrous surface structure which permits an adhesive to readily permeate and which, when wet, offers some resilience and an almost sponge-like characteristic. The adhesive is applied thereto using any of the myriad of known application techniques, such as but not limited to spraying, dipping, and brushing. In a preferred embodiment using hide glue, plug body 30 is first soaked in water, then in a mixture of equal parts glue and water, and finally only in glue. Plug body 30 is most preferably left with a sufficient layer of adhesive 32 to have an excess beyond that which permeates into the surface of the rough wood. While in the preferred embodiment plug 20, adhesive 32 is in the geometry of a contiguous layer, it will be understood by those skilled in the art that the adhesive may only partially encompass plug core 34. For exemplary though not limiting purposes, adhesive 32 may alternatively be in the shape of an applied spiral, presuming the method of application is controlled in such a way as to permit discontinuous application.

In one preferred embodiment, the adhesive used is commonly referred to as hide glue, which is water activated. In another preferred embodiment, the adhesive is a glue commonly used to seal envelopes, such as the X Grade High Clarity Glue sold by Milligan & Higgins of Johnstown, N.Y., a division of Hudson Industries Corporation. Plug body 30 will preferably be dipped into the adhesive and allowed to dry, though other techniques including but not limited to brushing and spraying may be used to apply the adhesive. The dipping may be accomplished by hanging plug 20 downward from the handle 40 and subsequently lowering into adhesive. A small dome 22 of adhesive may form due to surface tension, and such a formation is preferred, since dome 22 acts to serve as an adhesive reservoir for later use. Neither the selection of a particular glue nor the water activation are essential to the working of the invention, though both are preferred, as will be explained further herein below.

Reaming tool 10 will preferably be provided together with one or more plugs 20, such as in a kit or bag for retail sales. A person wishing to repair a stripped screw from a door, chair or the like will purchase the kit. As will be apparent, reaming tool 10 may be provided as shown for attachment to an electric drill chuck, or may instead include a manual tool handle for manipulation. Presuming reaming tool 10 is as shown, the person will secure coupling shaft 14 into a drill chuck, and then using the rotary power of the drill, press reaming tool 10 into the hole left by the stripped screw. Reaming tool 10 may be provided with many different edge patterns that, depending upon the design of the cutting portion of reaming tool 10 and the type of material being reamed, may tend to not only shape the hole, but also leave a relatively rough or potentially fibrous opening. As with plug body 30, a rough finish is preferred. The depth of the reaming operation is best measured by inserting a dry plug 20 into the reamed hole. When a dry plug 20 is hand placed and has about one thirty-second of an inch of plug body 30 extending out of the hole, the hole has been reamed sufficiently. Reaming the hole any deeper makes the process of forcefully driving plug body 30 into the hole more difficult, and reaming the hole any shallower will potentially induce too much interference prior to the plug fitting flush with the surface. Handle 40 will most preferably be used to insert and pull plug 20 from the hole. Without handle 40, there is a small but consequential risk of plug body 30 becoming stuck in the hole during hand fitting of dry plug 20, before the adhesive layer 32 has been activated. Since the primary purpose for handle 40 is to enable the removal of plug body 30 from a hole, the taper may preferably resemble that of plug body 30, extending from a relatively smaller diameter adjacent plug body 30 to a larger diameter distal therefrom to provide somewhat better grip. Other means for enhancing the gripping forces that typical persons may apply may also or alternatively be used, including but not limited to such techniques as forming a roughened surface thereon, or the introduction of small ribs or the like that are incorporated or created at the time when plug 20 is formed. Most preferably, handle 40 will be include a break-away feature which through geometry or designed defect will readily snap or be separated from plug body 30. In the preferred embodiment, the natural narrowing of material adjacent plug core 34 will present this break-away characteristic.

This approach of pre-placing a dry plug to determine proper reaming depth is believed to be a simple and reproducible method of establishing proper reaming depth. However, alternative ways of determining the depth may include special markers or shapes formed in reaming tool 10 to indicate the desired depth, alternative measuring instruments or tools, or other techniques known in the art of machining which may be appropriately applied herein.

Plug 20 will most preferably be soaked in warm water to moisten and re-activate adhesive coating 32 prior to being finally placed within the reamed hole. The amount of soaking time required will vary depending upon the type of adhesive used and the temperature of the water, but in the preferred embodiment this time is only twenty or thirty seconds. Too little soaking time implies that the glue is relatively too sensitive to water, and may either be so hydrophilic as to absorb water from the air on damp or humid days, or may fully dissolve into the water rather than simply being activated by the water. Too long a soaking time of course undesirably delays the repair. Consequently, in the preferred embodiment, the soaking time will range between approximately ten seconds and ten minutes. In the case of hide glue or the envelope adhesive identified herein above, the surface becomes tacky or sticky to the touch, but not messy to handle. The reamed hole will also preferably be brushed, wiped or otherwise treated with warm water. The water helps to ensure the adhesive migrates into the wood surrounding the reamed hole prior to excessive dehydration occurring.

Next, plug 20 will be pounded into the hole, for example by tapping on handle 40. Any air that could be trapped in a blind hole or the like will be vented through pilot hole 50, making the insertion somewhat easier when hole 50 is provided. Pilot hole 50 may, in the preferred embodiment, be designed to accommodate a relatively wide range of screws therein, reducing the need for large quantities of different sized inventory, and likewise reducing the need to manufacture many different and smaller lots of parts. The axial forces driving plug 20 into the hole will produce substantial radial forces on plug 20 that tend to hold plug 20 within the hole, and which also tend to squeeze adhesive from the fibrous exterior of plug core 34. While the adhesive from coating 32 migrates into the adjacent hole walls, the water will cause both the wood surrounding the hole and plug core 34 to swell, further ensuring a tight fit and adequate force to form a tight glue joint. A screw, nail or other fastener, whether the original fastener or one ordinarily to replace the one stripped from the original hole, may preferably be driven into the plug through hole 50 while the adhesive is still wet. This will, in fact, further tighten plug 20 into the hole, since such a fastener applies forces tending to expand plug 20 from the center outward radially. These forces only increase the strength of the fitting between plug 20 and hole 50. In addition, these forces will also tend to squeeze adhesive coating 32 out of plug core 34 and into the surrounding wood. Consequently, plug core 34 tends to behave like a sponge, storing adhesive prior to activation and then releasing adhesive from coating 32 into the wood surrounding a hole during use. During the insertion of a fastener within hole 50, using the preferred embodiment hide or envelope adhesives, there has been observed a significant heating at the interface between adhesive and fastener. This heating in the preferred embodiment may be used advantageously to provide a bond between fastener and adhesive, further improving the integrity of the repair. Adhesives will preferably be selected which will encourage this interaction.

The use of hide or envelope glue permits simple application, as described herein above, while the use of a water activated glue, which may be re-activated with water later, supports the simple activation, and only requires a user to have warm water available. The use of wood or a wood product as the material for plug 20 will more likely relatively closely match many common household and building materials to provide a long term attachment. Each of these features are preferred. While somewhat dependent upon the forces which will be supported by plug 20, the working load in many cases may be applied immediately rather than having to wait for the glue to have adequate time to form a strong bond.

However, in an alternative embodiment, alternative materials are contemplated for plug 20 and for the adhesive. These materials may include various natural materials, composites and synthetic compounds, but will most preferably still include the combination of friction fit within the slightly tapered hole and also the sponge effect, wherein the adhesive is carried within plug 20 and activated at the time of insertion into the hole. Various materials are known to have an open matrix which would sustain adequate quantities of adhesive, and include but are not limited to non-woven or woven webs; structural and other foams; natural materials including corks, sponges, balsa wood, whether in natural state or structurally or chemically enhanced; pressure-sensitive adhesives including those protected by waxed paper or other non-stick films; and many other similar known materials.

The specific selection of adhesive for adhesive coating 32 will be dependent upon the material chosen for plug 20, the composition of the material to be plugged, and the forces expected. Various adhesives are already well known and contemplated herein, including adhesives that are air or water-vapor activated, compounds wherein a hardener or catalyst may be applied onto the surface to initiate a chemical reaction, and other known compositions.

Once plug 20 is inserted within a hole, handle 40 will preferably be removed therefrom, such as by hammering at an angle relative to the longitudinal axis of plug 20. Even hammering of plug body 30 into a hole, typically by tapping on handle 40 with a hammer or the like, may result in a separation of handle 40 from plug body 30.

Figure 4:
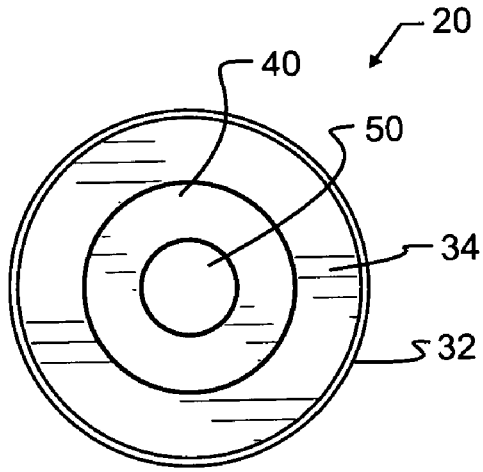
FIG. 4 illustrates the preferred embodiment plug of FIG. 1 from a top plan view.

Hole 50, in the preferred embodiment plug 20 as best visible in FIG. 4, will most preferably extend the full axial length of plug 20, and will additionally receive at least some adhesive in the form of a coating within hole 50. In the preferred embodiment, as long as the adhesive used to form adhesive coating 32 is adequately thinned, adhesive coating 32 will be coated both exterior to plug core 34 and interior to hole 50 simply in the aforementioned processing step of dipping. This coating is thought to enhance overall tensile strength whin hole 50, which is normally relatively weak owing to undesirable grain separation and cracking. The adhesive will also serve as a lubricant during the threading of a fastener within hole 50.

As an alternative, hole 50 may be formed only partially into plug body 30, or may be formed entirely through plug body 30 but not through handle 40. In once conceived embodiment, plug body 30 may have a point distal to handle 40. In such alternative, hole 50 would then not extend all the way to the tip, but would instead extend from the surface adjacent handle 40 to an interior of the plug core 34.

While the foregoing details what is felt to be the preferred embodiment of the invention, no material limitations to the scope of the claimed invention are intended. Further, features and design alternatives that would be obvious to one of ordinary skill in the art are considered to be incorporated herein. For example, while the most preferred embodiment is disclosed in association with a stripped screw hole, those skilled in the art upon review of the present disclosure will also recognize that the teachings herein may be applied to repairs of other defects or damage, such as the repair of holes from knots, insects, wild creatures, and the like. In such instance, forming the centrally located pilot hole will typically be skipped in the formation of the plug. Consequently, the scope of the invention is set forth and particularly described in the claims hereinbelow.

I claim:

1. A method for repair of a damaged fastener hole in an object using a reaming device and a generally conical plug, comprising the steps of:

reaming said damaged fastener hole with said reaming device to accept said conical plug;

providing a handle to said conical plug which extends out of said reamed damaged fastener hole when said conical plug is forced therein;

testing said reamed damaged fastener hole for proper size;

detaching said handle from said conical plug subsequent to said testing step;

activating an adhesive carried upon said conical plug responsive to said testing;

forcing said conical plug with said activated adhesive into said reamed damaged fastener hole;

installing a fastener into said conical plug; and setting said adhesive to form an adhesive bond between said conical plug and said reamed hole.

2. The method of claim 1 where said reaming of said damaged fastener hole includes reaming in depth as well as diameter.

3. The method of claim 1, wherein said applying step comprises dipping, to thereby simultaneously coat said hole and said outer surface.

4. The method of claim 1, wherein said step of testing further comprises the steps of:

inserting said conical plug in said reamed damaged fastener hole;

assessing a physical relationship between said conical plug and said reamed damaged fastener hole; and removing said conical plug.

5. The method of claim 1, wherein said step of installing further comprises installing said fastener into a radially central hole pre-manufactured in said conical plug.

6. The method of claim 1, wherein said step of installing said fastener further comprises thermoplastically deforming said adhesive.

7. The method of claim 1, further comprising the steps of:

applying an adhesive to said conical plug; and de-activating said adhesive prior to said testing step.

8. The method of claim 1, further comprising the step of forming an axially extensive and radially centered hole in said conical plug.

9. The method of claim 1, wherein said step of activating further comprises soaking said conical plug in a liquid for not less than 5 seconds nor more than 10 minutes.

10. A method for repair of a damaged fastener hole in an object using a reaming device and a generally conical plug, comprising the steps of:

applying an adhesive to said conical plug;

de-activating said adhesive to yield a deactivated adhesive conical plug;

reaming said damaged fastener hole with said reaming device to accept said conical plug;

testing said reamed damaged fastener hole for proper size using said deactivated adhesive conical plug;

activating said adhesive carried upon said conical plug responsive to said testing;

forcing said conical plug with said activated adhesive into said reamed damaged fastener hole;

installing a fastener into said conical plug; and setting said adhesive to form an adhesive bond between said conical plug and said reamed hole.

11. The method of claim 10, where said reaming of said damaged fastener hole includes reaming in depth as well as diameter.

12. The method of claim 10, further comprising the steps of:

providing a handle to said conical plug which extends out of said reamed damaged fastener hole when said conical plug is forced therein; and detaching said handle from said conical plug subsequent to said testing step.

13. The method of claim 10, wherein said applying step comprises dipping, to thereby simultaneously coat said hole and said outer surface.

14. The method of claim 10, wherein said step of testing further comprises the steps of:

inserting said conical plug in said reamed damaged fastener hole;

assessing a physical relationship between said conical plug and said reamed damaged fastener hole; and removing said conical plug.

15. The method of claim 10, wherein said step of installing further comprises installing said fastener into a radially central hole pre-manufactured in said conical plug.

16. The method of claim 10, wherein said step of installing said fastener further comprises thermoplastically deforming said adhesive.

17. The method of claim 10, further comprising the step of forming an axially extensive and radially centered hole in said conical plug.

18. The method of claim 10, wherein said step of activating further comprises soaking said conical plug in a liquid for not less than 5 seconds nor more than 10 minutes.

* * * * *